US005392997A

United States Patent [19]

Comensoli et al.

[11] Patent Number: 5,392,997

[45] Date of Patent: Feb. 28, 1995

[54] NON-IMPACT PULVERIZER AND METHOD OF USING

[76] Inventors: Inaco Comensoli, 2985 Lazy-A Street, Coquitlam, B.C., Canada, V3C 3N6; Mauro Comensoli, 719 Sydney Avenue, Coquitlam, B.C., Canada, V3K 3K3

[21] Appl. No.: 162,935

[22] Filed: Dec. 8, 1993

[51] Int. Cl.[6] ..... B02C 19/06

[52] U.S. Cl. ..... 241/5; 241/275

[58] Field of Search ..... 241/5, 39, 42, 43, 275, 241/DIG. 14

[56] References Cited

U.S. PATENT DOCUMENTS

| | | | |
|---|---|---|---|
| 2,155,374 | 4/1939 | Hartog | 241/DIG. 14 X |
| 2,280,619 | 4/1942 | Berry | 241/5 |
| 2,357,843 | 9/1944 | Morrissey | 241/275 |
| 3,028,103 | 4/1962 | Fisher | 241/5 |
| 3,224,685 | 12/1965 | Brack et al. | 241/5 |
| 3,270,398 | 9/1966 | Stewart | 241/275 X |
| 3,467,317 | 9/1969 | Stephanoff | 241/5 |
| 3,468,489 | 9/1969 | Andrews | 241/39 |
| 3,552,661 | 1/1971 | Bourne | 241/39 |
| 3,567,141 | 3/1971 | Zbraniborski | 241/275 X |
| 3,614,000 | 10/1971 | Blythe | 241/5 |
| 3,768,209 | 10/1973 | Punter et al. | 241/275 X |
| 3,869,090 | 3/1975 | Roussel et al. | 241/5 |
| 4,131,239 | 12/1978 | Stephanoff | 241/39 |
| 4,151,959 | 5/1979 | Deister | 241/69 |
| 4,521,996 | 6/1985 | Grund et al. | 241/275 X |
| 4,651,934 | 3/1987 | Bender et al. | 241/36 |
| 4,697,743 | 10/1987 | Bjorck et al. | 241/5 |
| 4,957,043 | 9/1990 | Silvestrini et al. | 241/DIG. 14 X |
| 5,240,190 | 8/1993 | Johnson | 241/74 |

FOREIGN PATENT DOCUMENTS

| | | | |
|---|---|---|---|
| 2035140 | 2/1972 | Germany | 241/275 |

*Primary Examiner*—Timothy V. Eley

*Attorney, Agent, or Firm*—Oyen Wiggs Green & Mutala

[57] ABSTRACT

Prior pulverizing apparatus which use rotating blades to pulverize the material require air as a pulverizing medium. The present invention uses a rotor structure which can operate in a vacuum if necessary.

10 Claims, 4 Drawing Sheets

NON-IMPACT PULVERIZER AND METHOD OF USING

TECHNICAL FIELD

The invention relates to devices for micronizing, pulverizing or comminuting particulate materials such as coal, lead, carbide, rock, wheat or like materials.

BACKGROUND ART

Numerous devices have been designed to pulverize materials, for example to turn wheat into flour, coal into coal dust, rock into powder and the like. Some of these devices use hammers, for example and others use rotating blades. For example, U.S. Pat. No. 3,028,103 issued Apr. 3, 1962 to Fisher discloses a comminuting apparatus which uses rotating rotor blades to rotate the material at high velocity, 7,000 rpm and above, using a rotor with a radius of about 6 inches, and having vortex-creating members on the inner wall of the casing to generate turbulence. The action of the air vortices on the material apparently results in comminution. U.S. Pat. No. 3,224,85 issued Dec. 21, 1965 to Brack et al. also discloses an apparatus for comminuting materials which uses a rotor having a series of radial impellers rotated at high speeds, on the order of 3,600 rpm. with rotors of 18 inches or 24 inches in diameter. Here pulverization is carried out apparently by eddy currents of air. These prior devices are sufficiently small, and require sufficiently high angular velocities, that a high throughput may not be economic. These prior art devices also require air in order to operate.

The present invention uses a rotating rotor to pulverize materials in a manner which can be operated in a vacuum. It has also been found that a much larger rotor, using a much lower angular velocity, can achieve efficient pulverization with a high throughput.

DISCLOSURE OF INVENTION

The present invention therefore provides an apparatus for pulverizing material in a vacuum comprising: a) a housing having an input and an output; b) a rotor mounted for rotation in said housing, and comprising a hollow hub, two circular parallel discs mounted co-axially on said hub, a plurality of flat blades extending between said discs, said hub having a front aperture opening to the hollow interior of said hub and a plurality of openings in the exterior of said hub between said blades; and c) means for rotating said rotor; wherein the input is adapted to feed said material to be pulverized to said hollow interior of said hub. A method of pulverizing in a vacuum is also disclosed.

BRIEF DESCRIPTION OF DRAWINGS

In drawings which illustrate a preferred embodiment of the invention.

BEST MODE(S) FOR CARRYING OUT THE INVENTION

Figure 1:
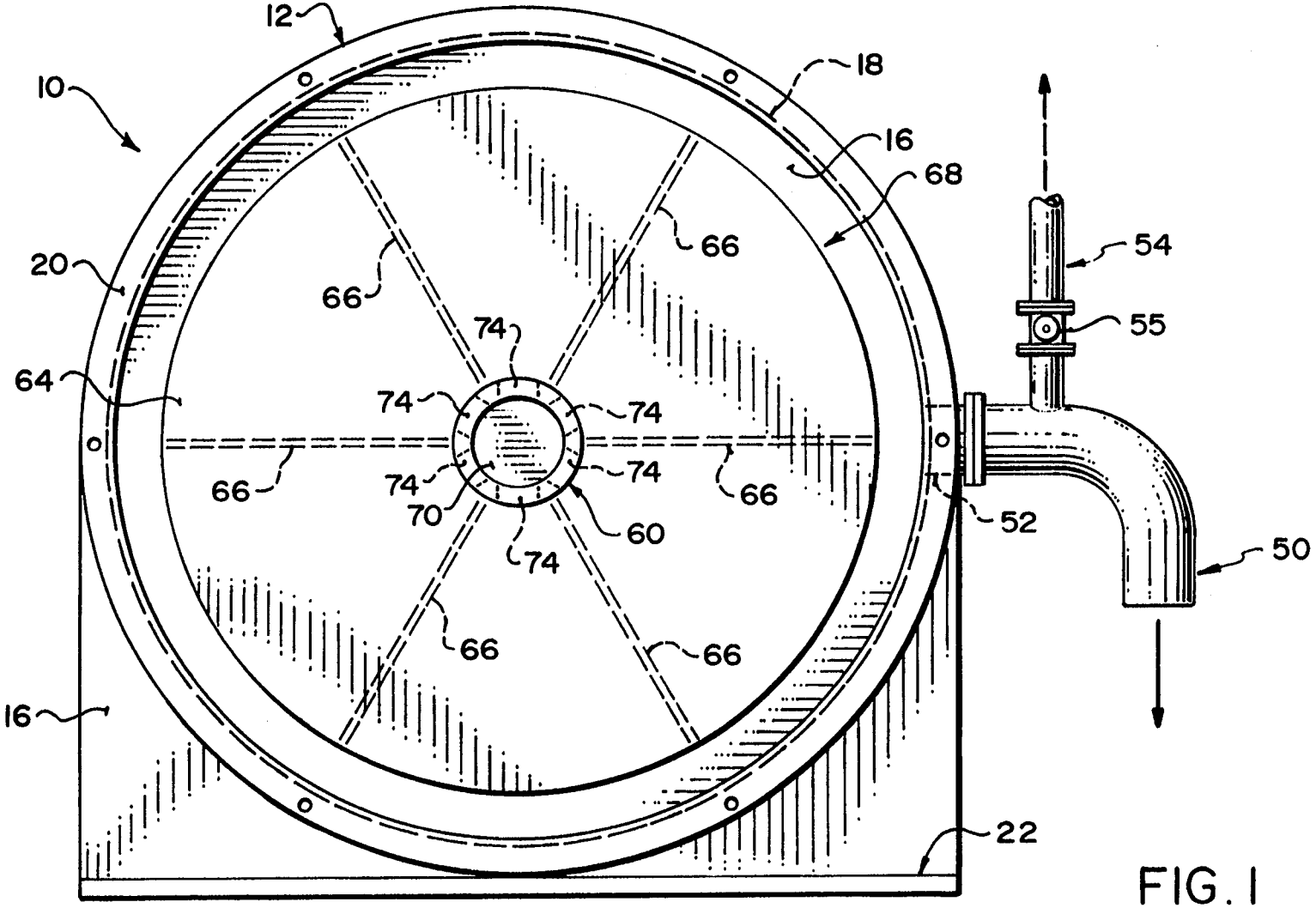
FIG. 1 is front elevation of the invention with the front face removed to show the rotor.
Figure 2:
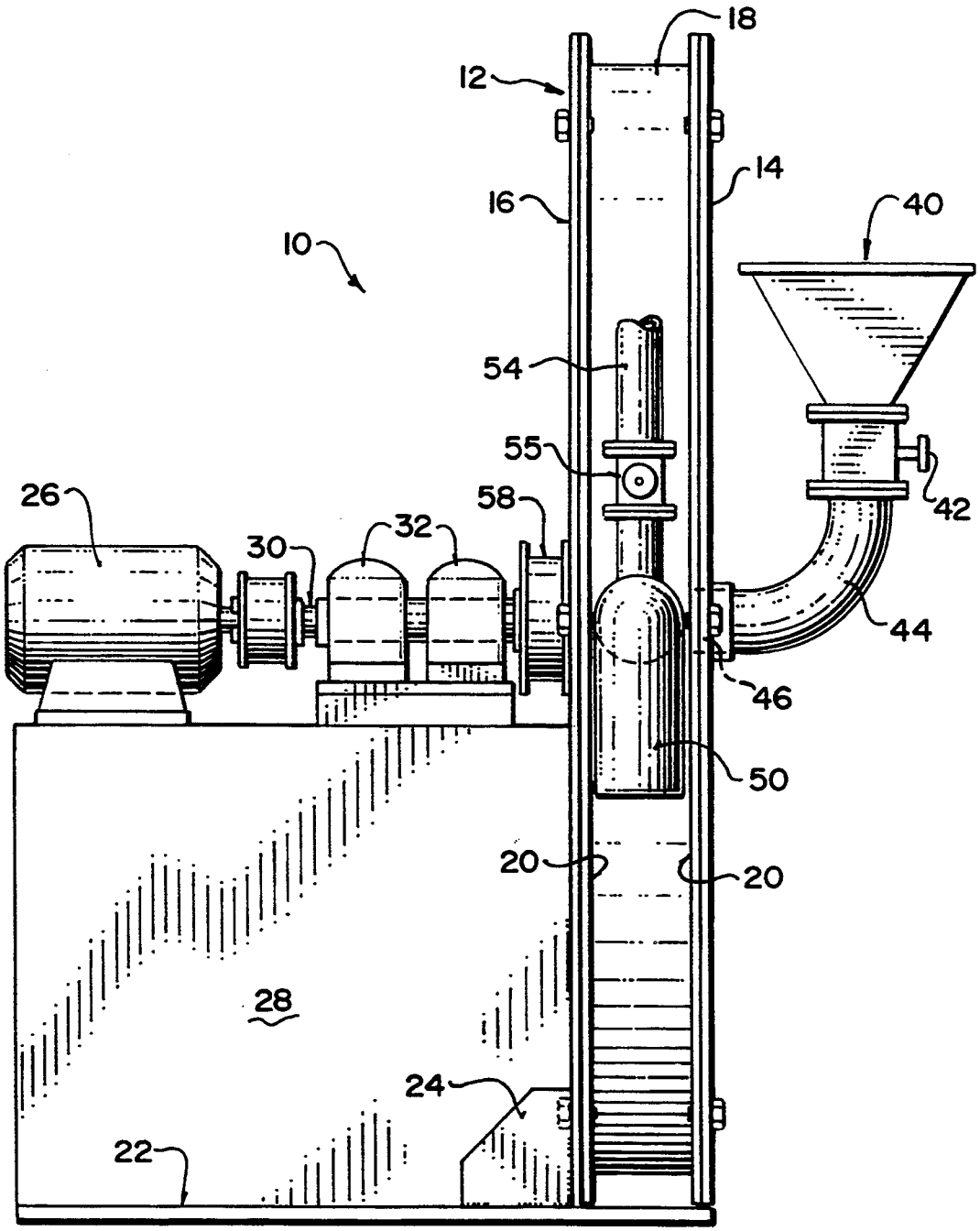
FIG. 2 is a right end elevation of the invention.
Figure 3:
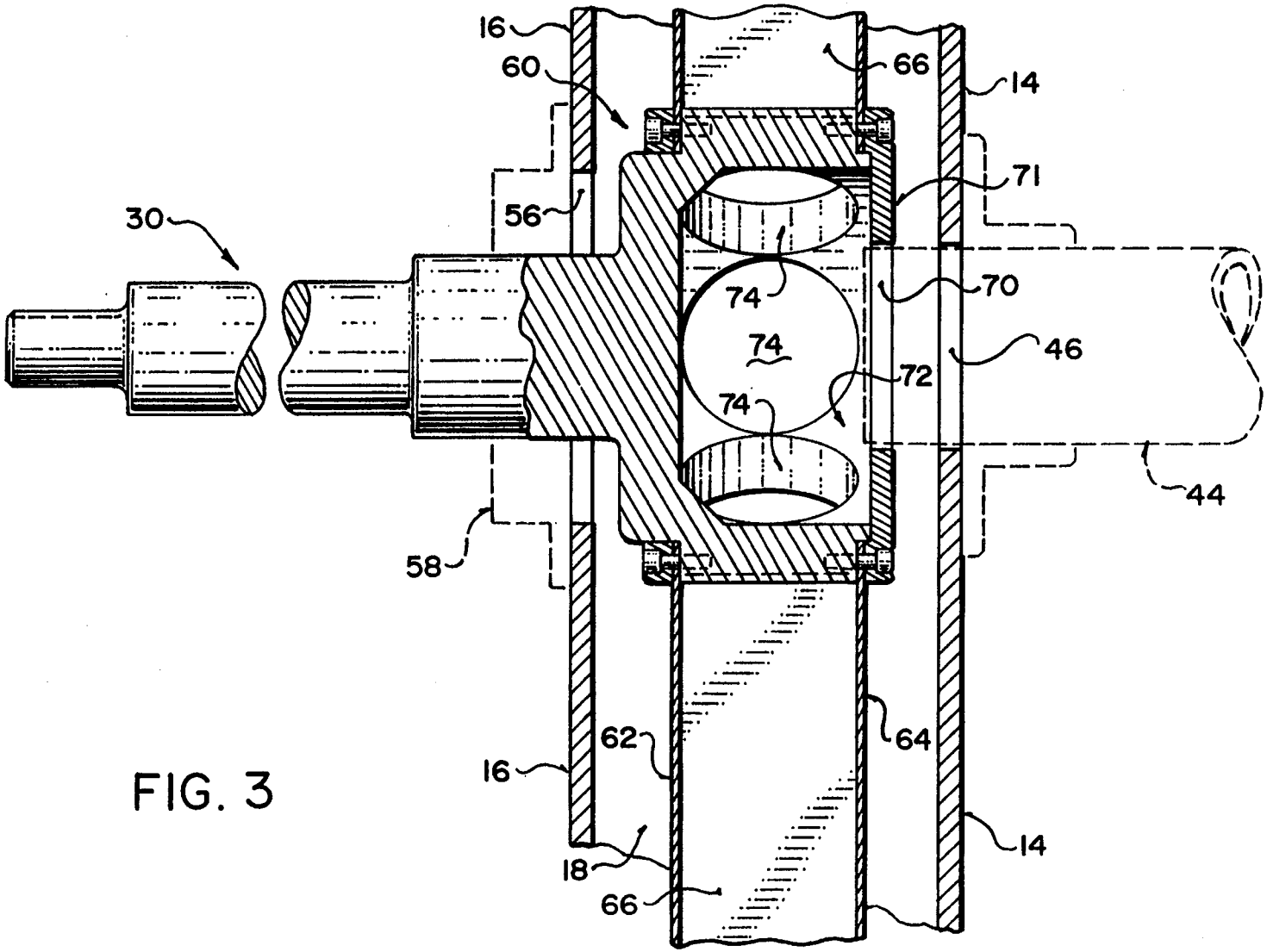
FIG. 3 is a detail of the rotor of the invention.
Figure 4:
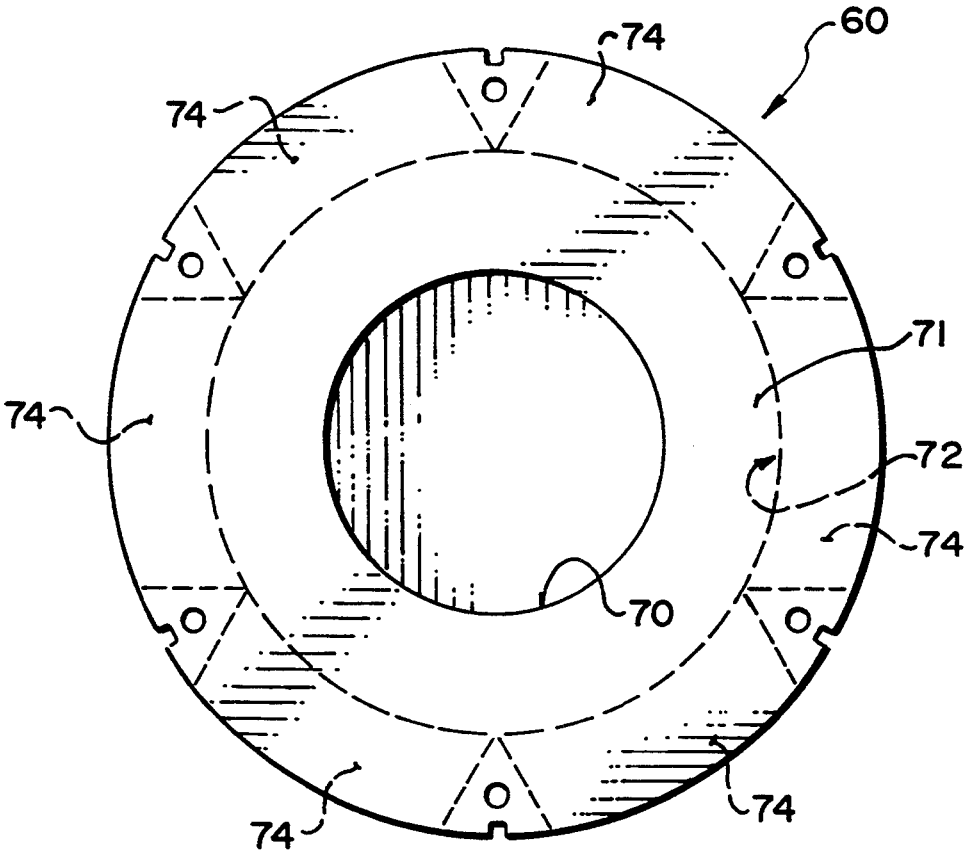
FIG. 4 is an elevation of the rotor hub of the invention.

With reference to FIG. 1 and 2, the apparatus of the invention is designated generally as 10. It has an annular hollow housing 12 formed of front face plate 14 and rear face plate 16 joined to circular cylindrical section 18 along circular flanges 20, the hollow interior of housing 12 thus forming a cylindrical space free of obstructions on the inner surface thereof. Face plates 14, 16 are mounted on a base 22 by a number of flanges 24. An electric motor 26 is mounted on base 22 on a narrow vertical motor mount 28. Motor 26 drives shaft 30 supported in bearings 32.

Housing 12 has an input hopper 40, shut valve 42 and input conduit 44 which communicates with the interior of housing 12 through a central hole 46 through face plate 14. An output conduit 50 communicates with the interior of housing 12 through a hole 52 in cylinder 18. Exhaust pipe 54 extends upwardly from, and communicates with the interior of, output conduit 50. A bag filter or other filtering means (not shown) is provided on the end of exhaust pipe 54. Valve 55 controls the exhaust flow.

Shaft 30 extends through a sealed hole 56 in face plate 16 sealed by sealing cap 58. Shaft 30 has mounted on the end thereof, within housing 12, hollow cylindrical hub 60. Parallel circular discs 62, 64 are mounted axially on hub 60. Six planar blades 66 are fixed between discs 62, 64 at equally spaced angular locations, each planar blade 66 forming a plane extending perpendicular to the surface of parallel discs 62, 64 continuously from hub go to the outer circumference of discs 62, 64. Discs 62, 64 have a diameter less than that of cylinder 18. Thus hub 60, discs 62, 64 and blades 66 form a rotor assembly 68 which rotates freely on shaft 30 within housing 12.

Hub 60 has a circular aperture 70 in the front face 71 thereof which communicates with hollow interior chamber 72. A circular opening 74 through hub 60 extends from the interior chamber 72 to the exterior of the hub centred in each space between blades 66.

In an embodiment as tested, discs 62, 64 had a diameter of 96 inches, and a separation (width of blades 66) of 6 inches. Hole 70 was approximately 7 inches in diameter and holes 74 about 6 inches in diameter.

In operation, a receptacle for the pulverized output is sealed over output conduit 50 and motor 26 is activated to rotate rotor 68 up to a speed of approximately 850 rpm. The material to be pulverized is introduced into inlet hopper 40 and valve 42 is opened. The material is then drawn into chamber 72 in hub 60 and exits through holes 74 between blades 66. The material travels outwardly between blades 66 and is pulverized when it reaches a point about $\frac{3}{4}$ of the distance along blades 66. The pulverized material then flows out conduit 50 into a storage receptacle and any air is exhausted out exhaust pipe 54. The device may also be used to vaporize liquids.

Like the Fisher and Brack devices, the present invention pulverizes the materials with little or no abrasion of the inner walls or blades of the device. Unlike prior devices however, the invention does not require the presence of air to operate and operates in a vacuum. For example the input hopper of the test device was sealed by a second valve from any entry of air, the rotor was operated up to speed to remove air from housing 12 and the material to be pulverized was introduced through valve 42 into the housing 12 after the air had been expelled for the most part. The device continued to pulverize the material with negligible air in the housing 12 and negligible abrasion on the interior surfaces. The physical explanation for the pulverizing action of the device is not completely understood.

Depending on the size and type of material to be pulverized, various modifications will be made to the inside and outside diameters of the rotor cavity, the length, width and number of blade's required, and horsepower and rpm of the motor. Ideally these factors are chosen so that the material is pulverized when it reaches a point approximately $\frac{3}{4}$ of the distance along the blade 66, therefore the material is substantially pulverized prior to any impact with the housing.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A method of non-impact pulverizing of material comprising:

i) providing an apparatus for pulverizing material comprising:

a) a housing having a hollow interior and an input conduit and an output conduit communicating with said hollow interior;

b) a cylindrical rotor mounted for rotation in said hollow interior of said housing, and comprising a hollow hub, two circular parallel discs mounted coaxially on said hub, a plurality of flat blades perpendicular to said parallel discs extending radially from said hub to a point adjacent the outer circumference of said circular discs between said discs, said hub having an aperture opening to the hollow interior of said hub and a plurality of openings in said hub between said blades communicating between the interior of said hub and an area between said blades;

c) power driven means for rotating said rotor; wherein said input conduit is adapted to direct said material to be pulverized to said hollow interior of said hub;

ii) rotating said rotor at high angular velocity; and iii) introducing said material into said hollow interior of said hub;

whereby said material is substantially pulverized prior to any impact with said housing.

2. The method of claim 1 wherein said rotor is rotated at an angular velocity of at least approximately 850 rpm.

3. The method of claim 1 wherein said rotor has a diameter of approximately 96 inches and is provided with six of said flat blades.

4. Apparatus for pulverizing material comprising:

a) a housing having a hollow interior and an input conduit and an output conduit communicating with said hollow interior;

b) a cylindrical rotor mounted for rotation in said hollow interior of said housing, and comprising a hollow hub, two circular parallel discs mounted coaxially on said hub, a plurality of flat blades perpendicular to said parallel discs extending radially from said hub to a point adjacent the outer Circumference of said circular discs between said discs, said hub having an aperture opening to the hollow interior of said hub and a plurality of openings in said hub between said blades communicating between the interior of said hub and an area between said blades;

c) power driven means for rotating said rotor; wherein said input conduit is adapted to direct said material to be pulverized to said hollow interior of said hub.

5. The apparatus of claim 4 wherein said output conduit further comprises a receptacle for pulverized material and an exhaust outlet.

6. The apparatus of claim 4 wherein said means for rotating said rotor is adapted to rotate said rotor at angular velocities of 850 rpm.

7. The apparatus of claim 4 wherein said housing is cylindrical and wherein said input conduit communicates with the interior of said housing along the axis thereof.

8. The apparatus of claim 4 wherein said input conduit is provided with means to prevent the introduction of air into said housing.

9. The apparatus of claim 4 wherein said input conduit is provided with valve means to control the introduction of materials to be pulverized into said housing.

10. The apparatus of claim 4 wherein the interior of said housing is free of obstructions.

* * * * *